US005552757A

United States Patent [19]

Blecha et al.

[11] Patent Number: 5,552,757

[45] Date of Patent: Sep. 3, 1996

[54] SURFACE-MOUNTED FUSE DEVICE

[75] Inventors: Vladimir Blecha, Aurora; Katherine M. McGuire, Clarendon Hills; Andrew J. Neuhalfen, Algonquin; Daniel B. Onken, Centralia, all of Ill.

[73] Assignee: Littelfuse, Inc., Des Plaines, Ill.

[21] Appl. No.: 247,584

[22] Filed: May 27, 1994

[51] Int. Cl.[6] ..... H01H 71/20; H01H 85/04; H01H 69/02

[52] U.S. Cl. ..... 337/297; 337/160; 337/152; 29/623

[58] Field of Search ..... 337/160, 152, 337/227, 297, 296

[56] References Cited

U.S. PATENT DOCUMENTS

| | | | |
|---|---|---|---|
| 3,619,725 | 11/1971 | Mendham et al. . | |
| 4,164,725 | 8/1979 | Wiebe | 337/198 |
| 4,198,744 | 4/1980 | Nicolay . | |
| 4,503,415 | 3/1985 | Rooney | 337/160 |
| 4,514,718 | 4/1985 | Birx | 337/407 |
| 4,533,896 | 8/1985 | Belopolsky . | |
| 4,540,969 | 9/1985 | Sugar . | |
| 4,547,830 | 10/1985 | Yamauchi . | |
| 4,612,529 | 9/1986 | Gurevich et al. . | |
| 4,626,818 | 12/1986 | Hilgers . | |
| 4,771,260 | 9/1988 | Gurevich | 337/231 |
| 4,837,520 | 6/1989 | Golke et al. . | |
| 4,873,506 | 10/1989 | Gurevich . | |
| 4,975,551 | 12/1990 | Syvertson | 200/144 C |
| 5,084,691 | 1/1992 | Lester et al. . | |
| 5,095,297 | 3/1992 | Perreault et al. . | |
| 5,097,246 | 3/1992 | Cook | 337/297 |
| 5,097,247 | 3/1992 | Doerrwaechter | 337/405 |
| 5,102,506 | 4/1992 | Tanielian | 205/118 |
| 5,115,220 | 5/1992 | Suuronen et al. . | |
| 5,140,295 | 8/1992 | Vermot-gaud et al. . | |
| 5,148,141 | 9/1992 | Suuronen . | |
| 5,155,462 | 10/1992 | Morrill | 337/3 |
| 5,166,656 | 11/1992 | Badihi et al. . | |
| 5,340,775 | 8/1994 | Carruthers | 437/246 |
| 5,363,082 | 11/1994 | Gurevich | 337/227 |
| 5,374,590 | 12/1994 | Batdorf | 437/173 |

FOREIGN PATENT DOCUMENTS

| | | |
|---|---|---|
| 0270954A1 | 6/1988 | European Pat. Off. . |
| 0581428A1 | 2/1994 | European Pat. Off. . |
| 3530354 | 3/1987 | Germany . |
| 1604820 | 12/1981 | United Kingdom . |
| 2089148 | 6/1982 | United Kingdom . |
| WO91/14279 | 9/1991 | WIPO . |

*Primary Examiner*—Leo P. Picard
*Assistant Examiner*—Stephen T. Ryan
*Attorney, Agent, or Firm*—Wallenstein & Wagner, Ltd.

[57] ABSTRACT

A thin film surface-mount fuse having two material subassemblies. The first subassembly includes a fusible link, its supporting substrate and terminal pads. The second subassembly includes a protective layer which overlies the fusible link so as to provide protection from impacts and oxidation. The protective layer is preferably made of a polymeric material. The most preferred polymeric material is a polycarbonate adhesive. In addition, the most preferred supporting substrate is an FR-4 epoxy or a polyimide.

17 Claims, 4 Drawing Sheets

SURFACE-MOUNTED FUSE DEVICE

DESCRIPTION

Technical Field

The invention relates generally to a surface-mountable fuse for placement into and protection of the electrical circuit of a printed circuit board.

Background of the Invention

Printed circuit (PC) boards have found increasing application in electrical and electronic equipment of all kinds. The electrical circuits formed on these PC boards, like larger scale, conventional electrical circuits, need protection against electrical overloads. This protection is typically provided by subminiature fuses that are physically secured to the PC board.

One example of such a subminiature, surface-mounted fuse is disclosed in U.S. Pat. No. 5,166,656 ('656 patent). The fusible link of this surface-mounted fuse is disclosed as being covered with a three layer composite which includes a passivation layer, an insulating cover, and an epoxy layer to bond the passivation layer to the insulating cover. See '656 patent, column 6, lines 4–7. Typically, the passivation layer is either chemically vapor-deposited silica or a thick layer of printed glass. See '656 patent, column 3, lines 39–41. The insulating cover may be a glass cover. See '656 patent, column 4, lines 43–46. In contrast, the present invention protects its fusible link with only one, rather than three, layers.

SUMMARY OF THE INVENTION

The invention is a thin film, surface-mounted fuse which comprises two material subassemblies. The first subassembly comprises a fusible link, its supporting substrate and terminal pads. The second subassembly comprises a protective layer which overlies the fusible link so as to provide protection from impacts and oxidation.

The protective layer is preferably made of a polymeric material. The most preferred polymeric material is a polycarbonate adhesive. In addition, the most preferred supporting substrate is an FR-4 epoxy or a polyimide.

A second aspect of the invention is a thin film, surface-mounted fuse. This fuse comprises a fusible link made of a conductive metal. The first conductive metal is preferably, but not exclusively, selected from the group including copper, silver, nickel, titanium, aluminum or alloys of these conductive metals. A second conductive metal, different from the first conductive metal, is deposited on the surface of this fusible link. One preferred metal for the surface-mounted fuse of this invention is copper. One preferred second conductive metal is tin.

The second conductive metal may be deposited onto the fusible link in the form of a rectangle, circle or in the form of any of several other configurations, such as, but not limited to, an S-shaped or serpentine configuration. If a rectangular or circular configuration is used, the second conductive metal is preferably deposited along the central portion of the fusible link.

Photolithographic, mechanical and laser processing techniques may be employed to create very small, intricate and complex fusible link geometries. This capability, when combined with the extremely thin film coatings applied through electrochemical and physical vapor deposition (PVD) techniques, enables these subminiature fuses to control the fusible area of the element and protect circuits passing microampere- and ampere-range currents. This is unique, in that prior fuses providing protection at these high currents were made with filament wires. The manufacture of such filament wire fuses created certain difficulties in handling.

The location of the fusible link at the top of the substrate of the present fuse enables one to use laser processing methods as a high precision secondary operation, in that way trimming the final resistance value of the fuse element.

DETAILED DESCRIPTION OF THE PREFERRED EMBODIMENT

Figure 1:
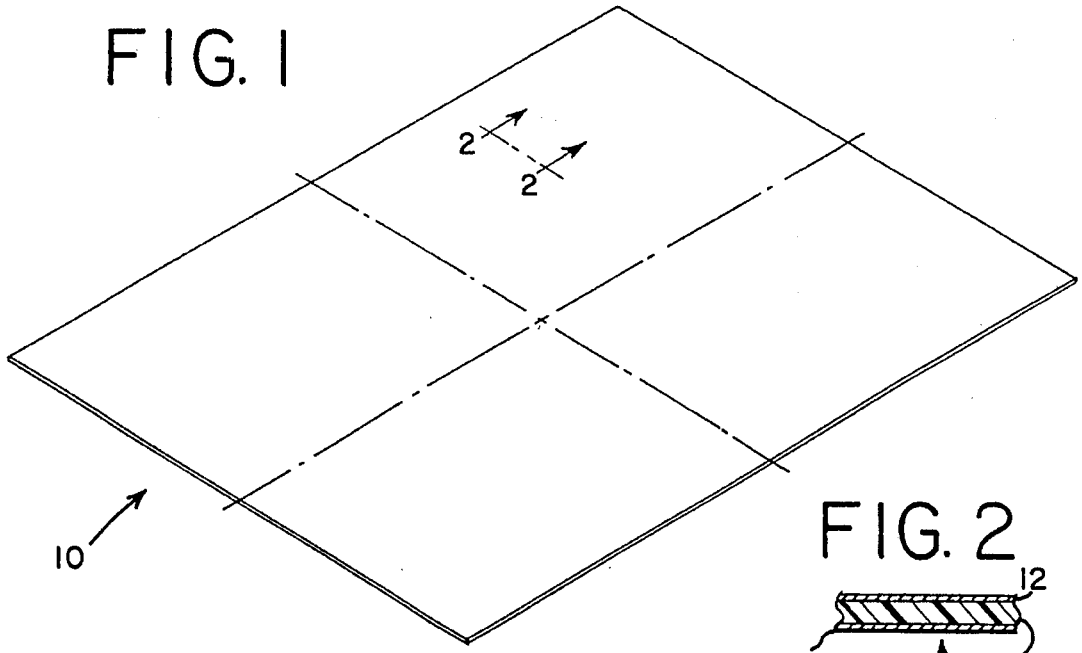
FIG. 1 is a perspective view of a copper-plated, FR-4 epoxy sheet used to make a subminiature surface-mounted fuse in accordance with the invention.

While this invention is susceptible of embodiment in many different forms, there is shown in the drawings and will herein be described in detail a preferred embodiment of the invention. It is to be understood that the present disclosure is to be considered as an exemplification of the principles of the invention. This disclosure is not intended to limit the broad aspect of the invention to the illustrated embodiment or embodiments.

Figure 12:
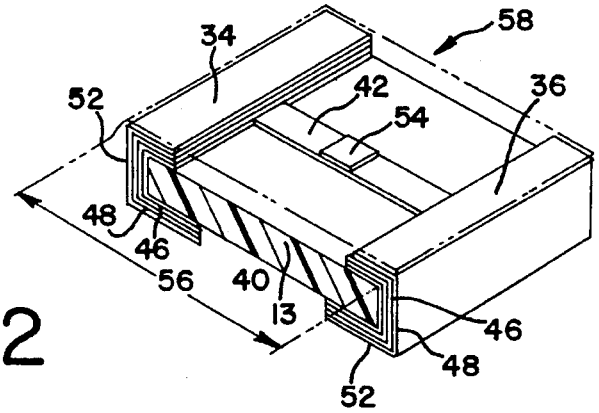
FIG. 12 shows the individual fuse in accordance with the invention as it is finally made, and after a so-called dicing operation in which a diamond saw is used to cut the strips along parallel planes to form these individual surface-mountable fuses.

One preferred embodiment of the present invention is shown in FIG. 12. The thin film, surface-mounted fuse is a subminiature fuse used in a surface mount configuration on a PC board or on a thick film hybrid circuit. These fuses are typically known in the art as "A" case fuses. The standard industry size for these fuses is 125 mils. long by 60 mils. wide. Such fuses are designated, for shorthand purposes, as 1206 fuses. It will be understood, however, that the present invention can be used on all other standard sizes of such fuses, such as 1210, 0805, 0603 and 0402 fuses, as well as non-standard sizes.

In its broadest concept, the invention comprises two material subassemblies. As will be seen, the first subassembly includes the fuse element or fusible link 42, its supporting substrate or core 13, and terminal pads 34 and 36 for connecting the fuse 58 to the PC board. The second subassembly is a protective layer 56 which overlies the fusible link 42 and a substantial portion of the top portion of the fuse so as to provide protection from impacts which may occur during automated assembly, and protection from oxidation during use.

The first subassembly contains and supports two metal electrodes or pads and the fusible element, both of which are bonded to the substrate as a single continuous film. The pads are located on the bottom and sides of the substrate or core, while the fusible link is located at the top of the substrate or core.

As will be seen, in the preferred embodiment, pads are made up of several layers, including a base copper layer, a supplemental copper layer, a nickel layer and a tin layer. The base copper layer of the pads and the thin film fusible link are simultaneously deposited by (1) electrochemical processes, such as the plating described in the preferred embodiment below; or (2) by PVD. Such simultaneous deposition ensures a good conductive path between the fusible link and the terminal pads. This type of deposition also facilitates manufacture, and permits very precise control of the thickness of the fusible link.

After initial placement of the fusible link and the base copper onto the substrate or core, additional layers of a conductive metal are placed onto the terminal pads. These additional layers could be defined and placed onto these pads by photolithography and deposition techniques, respectively.

Figure 2:
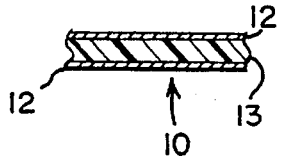
FIG. 2 is a view of a portion of the sheet of FIG. 1, and taken along lines 2—2 of FIG. 1.

This fuse may be made by the following process. Shown in FIGS. 1 and 2 is a solid sheet 10 of an FR-4 epoxy with copper plating 12. The copper plating 12 and the FR-4 epoxy core 13 of this solid sheet 10 may best be seen in FIG. 2. This copper-plated FR-4 epoxy sheet 10 is available from Allied Signal Laminate Systems, Hoosick Falls, N.Y., as Part No. 0200BED130C1/C1GFN0200 C1/C1A2C. Although FR-4 epoxy is a preferred material, other suitable materials include any material that is compatible with, i.e., of a chemically, physically and structurally similar nature to, the materials from which PC boards are made. Thus, another suitable material for this solid sheet 10 is polyimide. FR-4 epoxy and polyimide are among the class of materials having physical properties that are nearly identical with the standard substrate material used in the PC board industry. As a result, the fuse of the invention and the PC board to which that fuse is secured have extremely well-matched thermal and mechanical properties. The substrate of the fuse of the present invention also provides desired arc-tracking characteristics, and simultaneously exhibits sufficient mechanical flexibility to remain intact when exposed to the rapid release of energy associated with arcing.

In the next step of the process of manufacturing the fuses of the present invention, the copper plating 12 is etched away from the solid sheet 10 by a conventional etching process. In this conventional etching process, the copper is etched away from the substrate by a ferric chloride solution.

Although it will be understood that after completion of this step, all of the copper layer 12 of FIG. 2 is etched away from FR-4 epoxy core 13 of this solid sheet 10, the remaining epoxy core 13 of this FR-4 epoxy sheet 10 is different from a "clean" sheet of FR-4 epoxy that had not initially been treated with a copper layer. In particular, a chemically etched surface treatment remains on the surface of the epoxy core 13 after the copper layer 12 has been removed by etching. This treated surface of the epoxy core 13 is more receptive to subsequent operations that are necessary in the manufacture of the present surface-mounted subminiature fuse.

Figure 3:
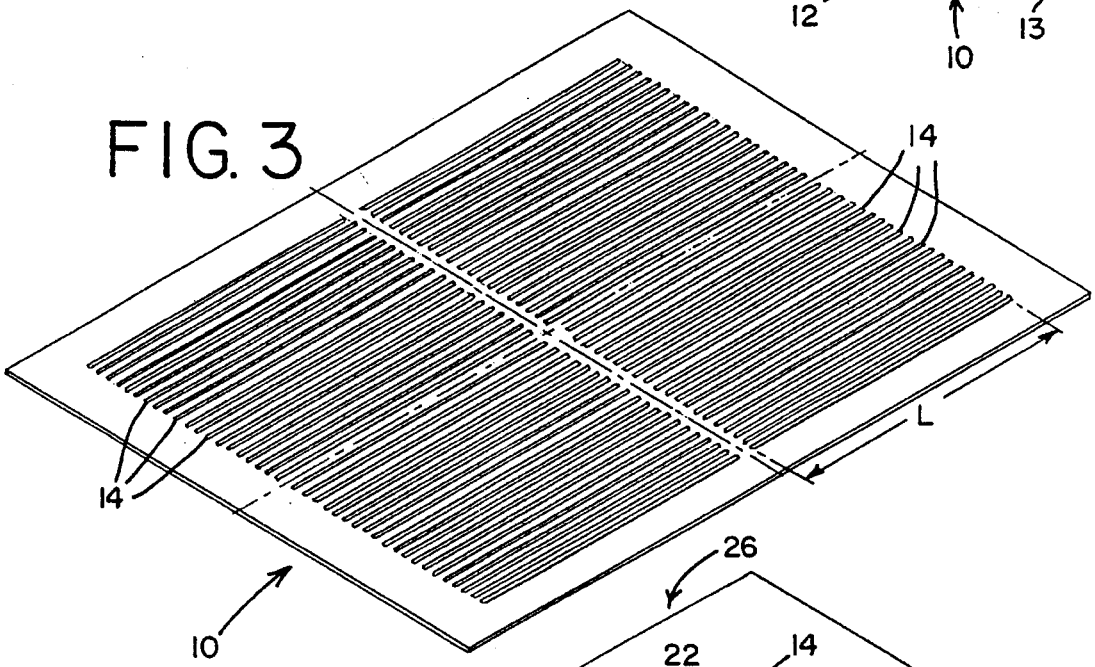
FIG. 3 is a perspective view of the FR-4 epoxy sheet of FIG. 1, but stripped of its copper plating, and with a plurality of slots, each having a width W and a length L, routed into separate quadrants of that sheet.

The FR-4 epoxy sheet 10 having this treated, copper-free surface is then routed or punched to create slots 14 along quadrants of the sheet 10, as may be seen in FIG. 3. Dotted lines visually separate these four quadrants in FIG. 3. The width W of the slots 14 (FIG. 4) is about 0.0625 inches. The length L of each of the slots 14 (FIG. 3) is approximately 5.125 inches.

When the routing or punching has been completed, the etched and routed or punched sheet 10 shown in FIG. 3 is again plated with copper. This reapplication of copper occurs through the immersion of the etched and routed sheet of FIG. 3 into an electroless copper plating bath. This method of copper plating is well-known in the art.

This copper plating step results in the placement of a copper layer having a uniform thickness along each of the exposed surfaces of the sheet 10. For example, as may be seen in FIG. 4, the copper plating 18 resulting from this step covers both (1) the flat, upper surfaces 22 of the sheet 10; and (2) the vertical, interstitial regions 16 that define at least a portion of the slots 14. These interstitial regions 16 must be copper-plated because they will ultimately form a portion of the terminal pads of the final fuse.

The uniform thickness of the copper plating will depend upon the ultimate needs of the user. Particularly, as may be seen in FIG. 4, for a fuse intended to open at 1/16 ampere, the copper plating 18 has a thickness of 2,500 Angstroms. For a fuse intended to open at 5 amperes, the copper plating 18 has a thickness of approximately 75,000 Angstroms.

Figure 4:
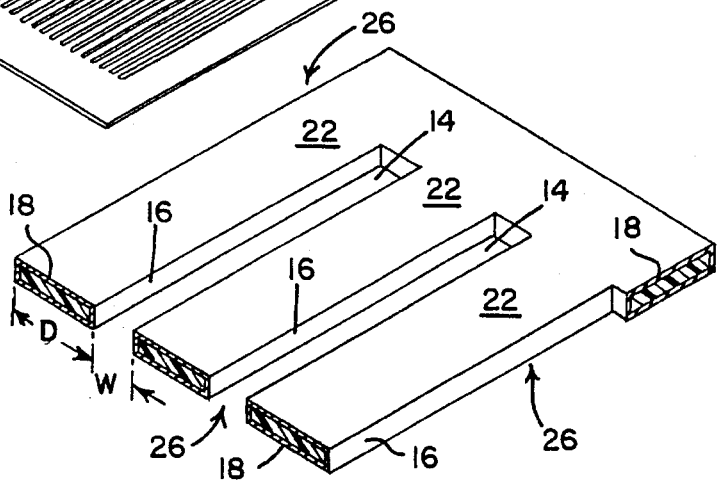
FIG. 4 is an enlarged, perspective view of a portion of the routed sheet of FIG. 2, but with a copper plating layer having been reapplied.

After plating has been completed, to arrive at the copper-plated structure of FIG. 4, the entire exposed surface of this structure is covered with a so-called photoresist polymer.

An otherwise clear mask is placed over the replated copper sheet 20 after it has been covered with the photoresist. Square panels are a part of, and are evenly spaced across, this clear mask. These square panels are made of an UV light-opaque substance, and are of a size corresponding to the size of the rectangle 30 shown in FIG. 5. Essentially, by placing this mask having these panels onto the replated copper sheet 20, several portions of the flat, upward-facing surfaces 22 of the replated copper sheet 20 are effectively shielded from the effects of UV light.

It will be understood from the following discussion that these square panels will essentially define the shapes and sizes of the so-called fusible link 42 and the wide terminal areas 60 and 62 on the upper portion 22 of the fuse. The fusible link 42 is in electrical communication with the wide terminal areas 60 and 62. It will be appreciated that the width, length and shape of both the fusible link 42 and these wide terminal areas 60 and 62 may be altered by changing the size and shape of these UV light-opaque panels.

Additionally, the backside of the sheet is covered with a photoresist material and an otherwise clear mask is placed over the replated copper sheet 20 after it has been covered with the photoresist. A rectangular panel is a part of this clear mask. The rectangular panels are made of a UV light-opaque substance, and are of a size corresponding to the size of the panel 28 shown in FIG. 6. Essentially, by placing this mask having these panels onto the replated copper sheet 20, several strips of the flat, downward-facing surfaces 28 of the replated copper sheet 20 are effectively shielded from the effects of the UV light.

The rectangular panels will essentially define the shapes and sizes of the wide terminal areas 34 and 36 on the lower middle portion 28 of the underside of the strip 26.

Figure 6:
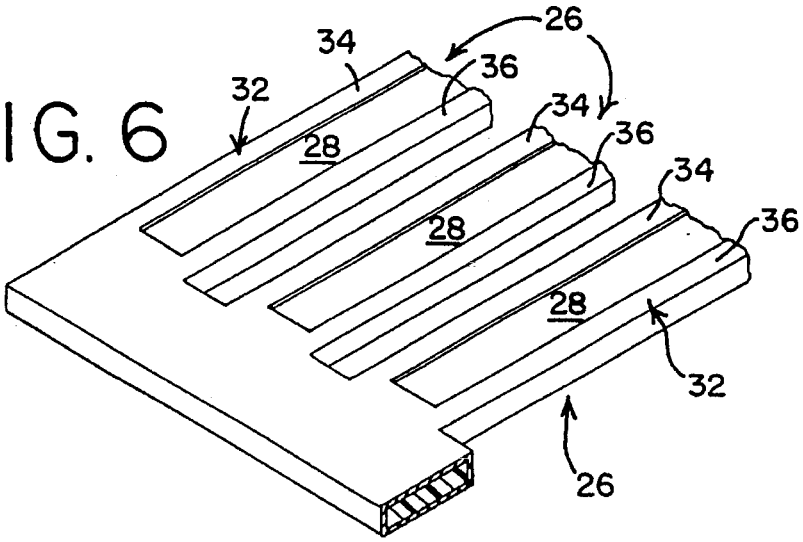
FIG. 6 is a perspective view of the reverse side of FIG. 5, but after the removal of a strip-like portion of copper plating from the replated sheet of FIG. 5.

The copper plating from a portion of the underside of a strip 26 is defined by a photoresist mask. Particularly, the copper plating from the lower, middle portion 28 of the underside of the strip 26 is removed. The lower, middle portion 28 of the underside of the strip 26 is that part of the strip along a line immediately beneath the areas 30 of clear epoxy. A perspective view of this section of this replated sheet 20 is shown in FIG. 6.

The entire replated, photoresist-covered sheet 20, i.e., the top, bottom and sides of that sheet, is then subjected to UV light. The replated sheet 20 is subjected to the UV light for a time sufficient to ensure curing of all of the photoresist that is not covered by the square panels and rectangular strips of the masks. Thereafter, the masks containing these square panels and rectangular strips are removed from the replated sheet 20. The photoresist that was formerly below these square panels remains uncured. This uncured photoresist is still in a liquid form and, thus, may be washed from the replated sheet 20.

The cured photoresist on the remainder of the replated sheet 20 provides protection against the next step in the process. Particularly, the cured photoresist prevents the removal of copper beneath those areas of cured photoresist. The regions formerly below the square panels have no cured photoresist and no such protection. Thus, the copper from those regions can be removed by etching. This etching is performed with a ferric chloride solution.

Figure 5:
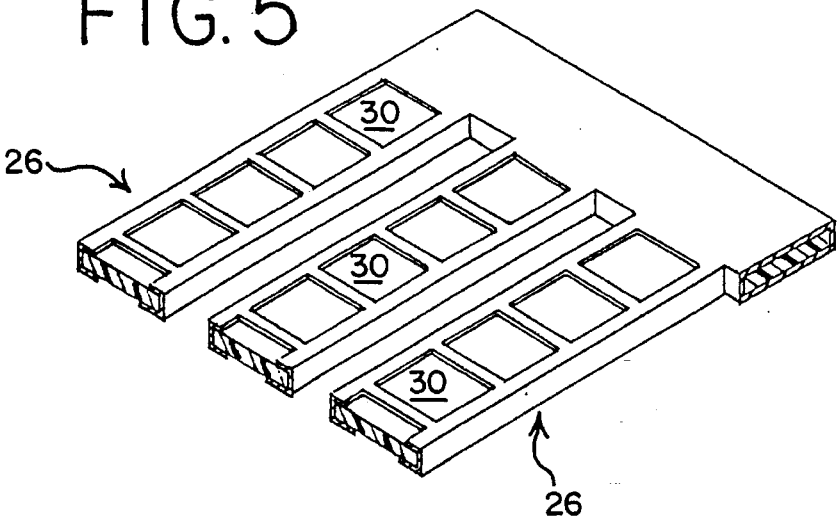
FIG. 5 is a top view of several portions of the flat, upward-facing surfaces of the replated copper sheet, after each of those portions were masked with a square panel of an ultraviolet (UV) light-opaque substance.

After the copper has been removed, as may be seen in FIGS. 5 and 6, the regions formerly below the square panels and the rectangular strips of the mask are not covered at all. Rather, those regions now comprise areas 28 and 30 of clear epoxy.

The replated sheet 20 is then placed in a chemical bath to remove all of the remaining cured photoresist from the previously cured areas of that sheet 20.

For the purposes of this specification, the portion of the sheet 20 between adjacent slots 14 is known as a strip 26. This strip has a dimension D as shown in FIG. 4 which defines the length of the device. After completion of several of the operations described in this specification, this strip 26 will ultimately be cut into a plurality of pieces, and each of these pieces becomes a fuse in accordance with the invention.

As may also be seen from FIG. 6, the underside 32 of the strip 26 has regions along its periphery which still include copper plating. These peripheral regions 34 and 36 of the underside 32 of the strip 26 form portions of the pads. These pads will ultimately serve as the means for securing the entire, finished fuse to the PC board.

Figure 7:
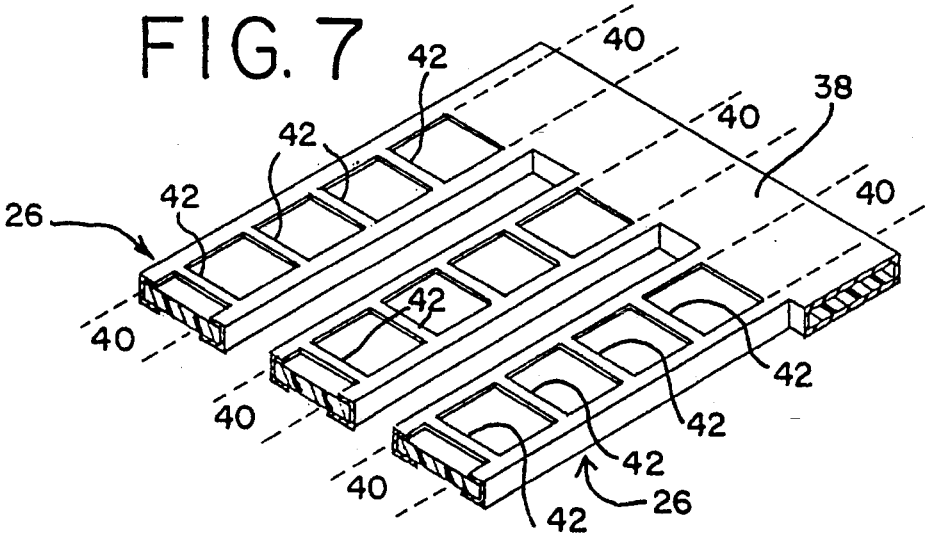
FIG. 7 is a perspective view of the top-side 38 of the strip 26 of FIG. 6, and showing linear regions 40 defined by dotted lines.

FIG. 7 is a perspective view of the top-side 38 of the strips 26 of FIG. 6. Directly opposite and coinciding with the lower, middle portions 28 of these strips 26 are linear regions 40 on this top-side 38. These linear regions 40 are defined by the dotted lines of FIG. 7.

FIG. 7 is to be referred to in connection with the next step in the manufacture of the invention. In this next step, a photoresist polymer is placed along each of the linear regions 40 of the top side 38 of the strips 26. Through the covering of these linear regions 40, photoresist polymer is also placed along the relatively thin portions which will comprise the fusible links 42. These fusible links 42 are made of a conductive metal, here copper. The photoresist polymer is then treated with UV light, resulting in a curing of the polymer onto linear region 40 and its fusible links 42.

As a result of the curing of this polymer onto the linear region 40 and its fusible links 42, metal will not adhere to this linear region 40 when the strip 26 is dipped into an electrolytic bath containing a metal for plating purposes.

In addition, as explained above, the middle portion 28 of the underside 32 of the strip 26 will also not be subject to plating when the strip 26 is dipped into the electrolytic plating bath. Copper metal previously covering this metal portion had been removed, revealing the bare epoxy that forms the base of the sheet 20. Metal will not adhere to or plate onto this bare epoxy using an electrolytic plating process.

Figure 8:
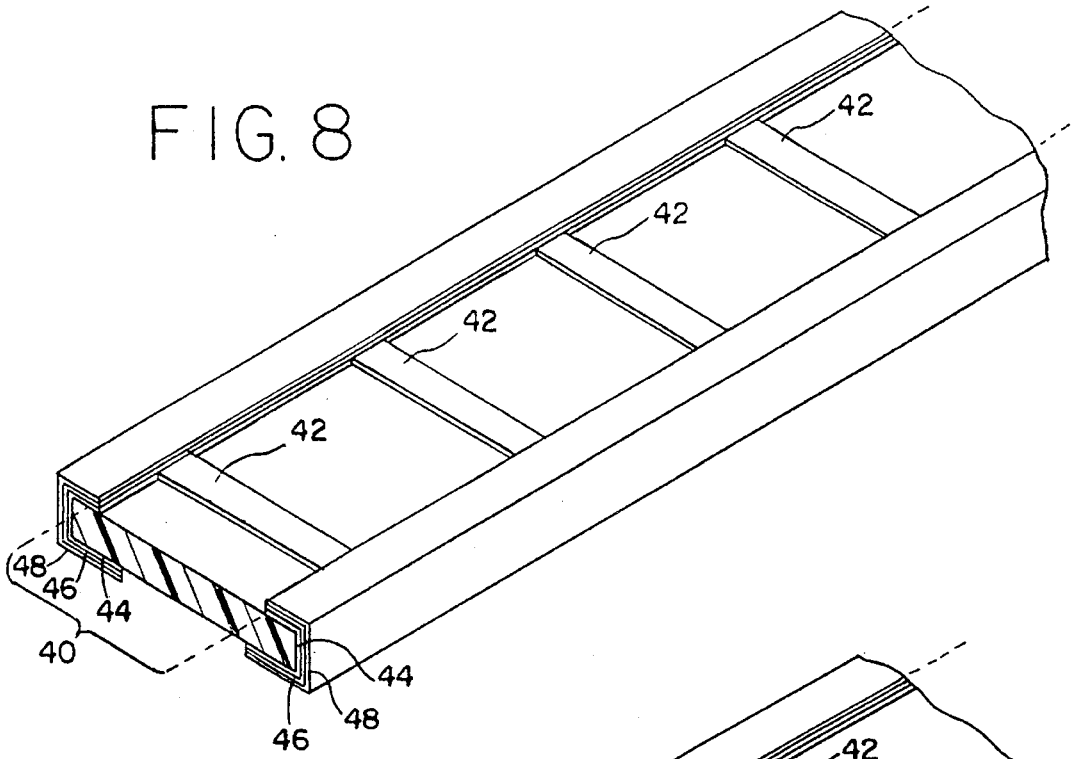
FIG. 8 is a view of a single strip 26 after dipping into a copper plating bath and then a nickel plating bath, with the result that copper and nickel layers are deposited onto the base copper layer of the terminal pads.

The entire strip 26 is dipped into an electrolytic copper plating bath and then an electrolytic nickel plating bath. As a result, as may be seen in FIG. 8, copper 46 and nickel layers 48 are deposited on the base copper layer 44. After deposition of these copper 46 and nickel layers 48, the cured photoresist polymer on the linear region 40, including the photoresist polymer on the fusible links 42, is removed from that region 40.

Photoresist polymer is then immediately reapplied along the entire linear region 40. As may be seen in FIG. 9, however, a portion 50 at the center of the fusible link 42 is masked with a UV light-opaque substance. The entire linear region 40 is then subjected to UV light, with the result that curing of the photoresist polymer occurs on all of that region, except for the masked central portion 50 of the fusible link 42. The mask is removed from the central portion 50 of the fusible link, and the strip is rinsed. As a result of this rinsing, the uncured photoresist above the central portion 50 of the fusible link 42 is removed from the fusible link. The cured photoresist along the remainder of the linear region 40, however, remains.

Plating of metal will not occur on the portion of the strip 26 covered by the cured photoresist. Because of the absence of the photoresist from the central portion 50 of the fusible link 42, however, metal may be plated onto this central portion 50.

Figure 9:
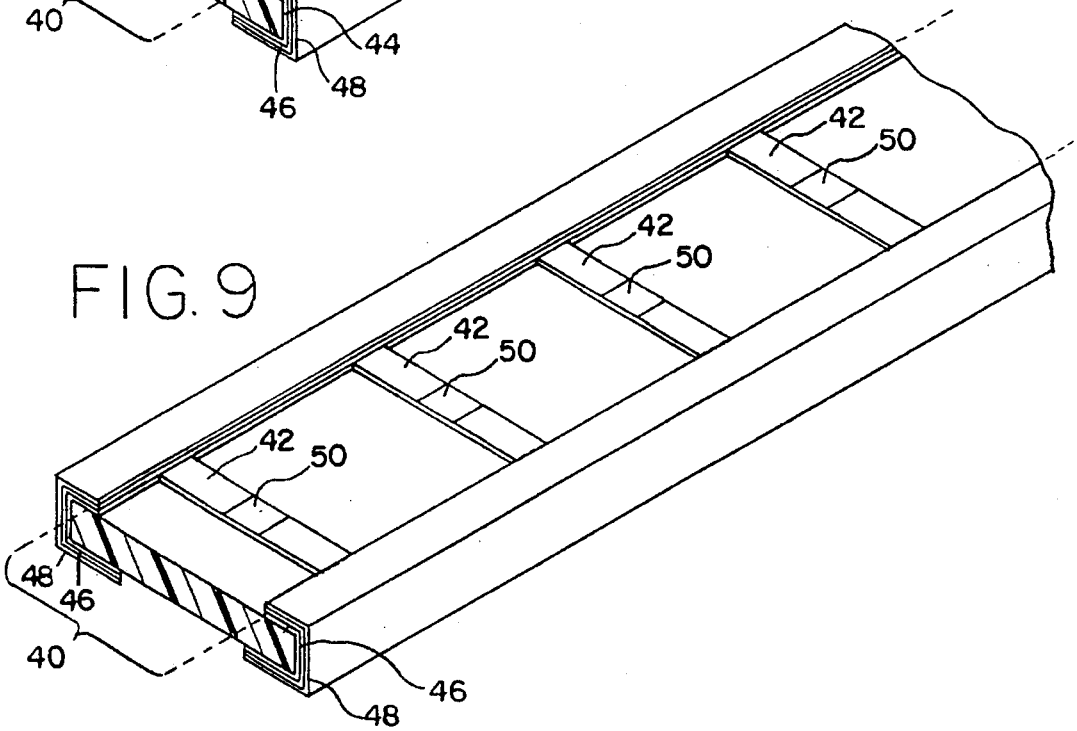
FIG. 9 is a perspective view of the strip of FIG. 8, but prior to UV light curing, and showing a portion 50 at the center of fusible link 42 that is masked with a UV light-opaque substance.
Figure 10:
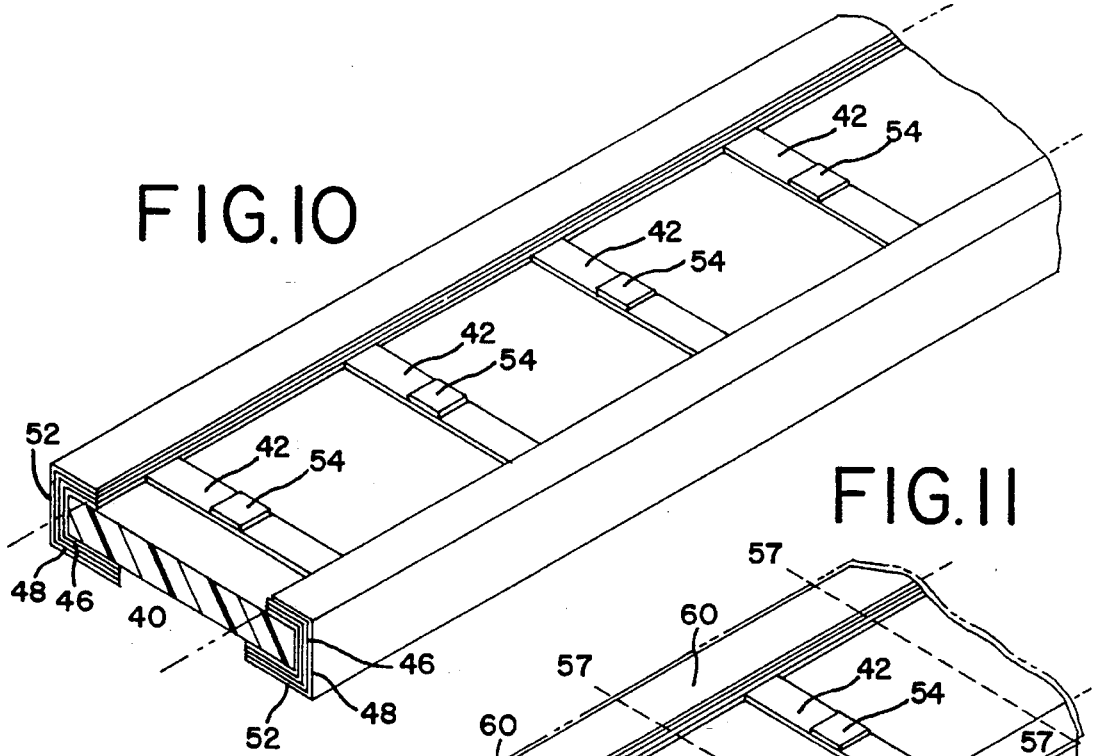
FIG. 10 shows the strip of FIG. 9, but after immersion into a tin plating bath to create another layer over the copper and nickel layers, and after deposition of tin onto the central portion of the fusible link.

When the strip shown in FIG. 9 is dipped into an electrolytic tin plating bath, a tin layer 52 (FIG. 10) is overlain over the copper 46 and nickel layers 48. A tin spot 54 is also deposited onto the surface of the fusible link 42, i.e., essentially placed by an electrolytic plating process onto the central portion 50 of the fusible link 42. This electrolytic plating process is essentially a thin film deposition process. It will be understood, however, that this tin may also be added to the surface of the fusible link 42 by a photolithographic process or by means of a physical vapor deposition process, such as sputtering or evaporation in a high vacuum deposition chamber.

This spot 54 is comprised of a second conductive metal, i.e., tin, that is dissimilar to the copper metal of the fusible link 42. This second conductive metal in the form of the tin spot 54 is deposited onto the fusible link 42 in the form of a rectangle.

The tin spot 54 on the fusible link 42 provides that link 42 with certain advantages. First, the tin spot 54 melts upon current overload conditions, creating a fusible link 42 that becomes a tin-copper alloy. This tin-copper alloy results in a fusible link 42 having a lower melting temperature than either the tin or copper alone. The lower melting temperature reduces the operating temperature of the fuse device of the invention, and this results in improved performance of the device.

Although tin is deposited on the copper fusible link 42 in this example, it will be understood by those skilled in the art that other conductive metals may be placed on the fusible link 42 to lower its melting temperature, and that the fusible link 42 itself may be made of conductive metals other than copper. In addition, the tin or other metal deposited on the fusible link 42 need not be of a rectangular shape, but can take on any number of additional configurations.

The second conductive metal may be placed in a notched section of the link, or in holes or voids in that link. Parallel fuse links are also possible. As a result of this flexibility, specific electrical characteristics can be engineered into the fuse to meet varying needs of the ultimate user.

As indicated above, one of the possible fusible link configurations is a serpentine configuration. By using a serpentine configuration, the effective length of the fusible link may be increased, even though the distance between the terminals at the opposite ends of that link remain the same. In this way, a serpentine configuration provides for a longer fusible link without increasing the dimensions of the fuse itself.

Figure 11:
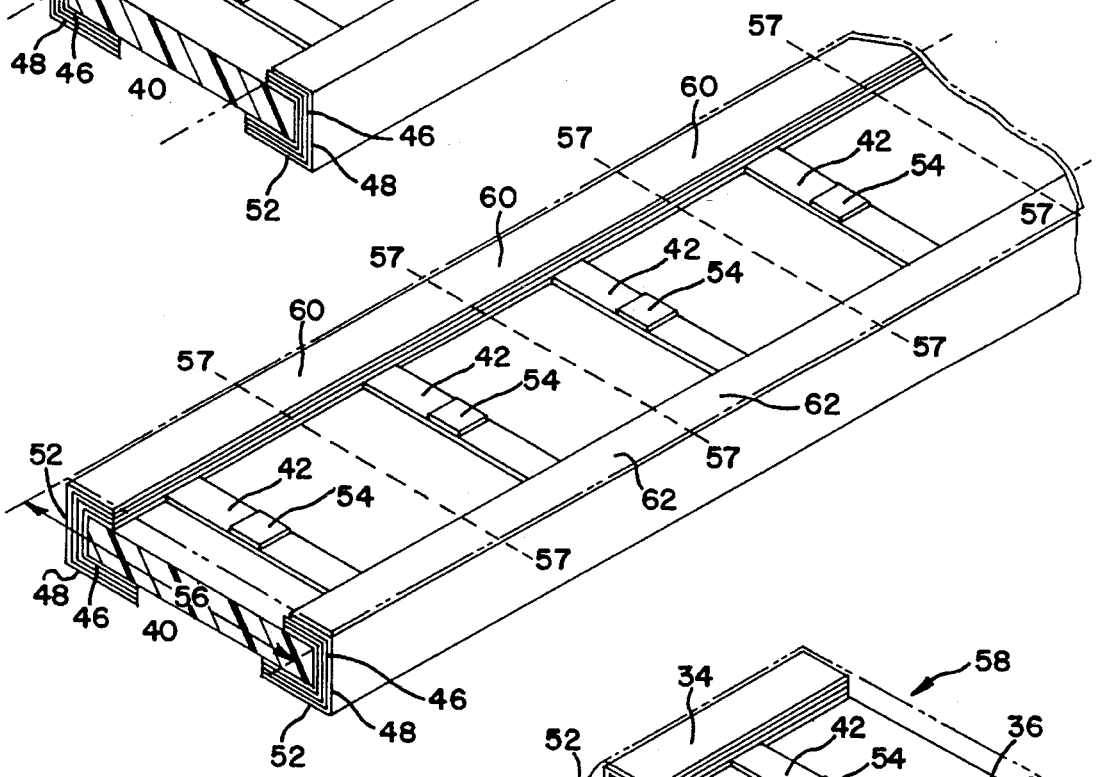
FIG. 11 shows the strip of FIG. 10, but with an added termoplastic adhesive layer onto the top of the strip 26.

The next step in the manufacture of the device of the invention is the placement, across the length of the entire top portion 38 of the strip 26, of a protective layer 56 (FIG. 11). This protective layer 56 is the second subassembly of the present fuse, and forms a relatively tight seal over the top portion 38 of the strip 26, including the fusible link 42. In this way, the protective layer 56 inhibits corrosion of the fusible links 42 during their useful lives. The protective layer 56 also provides protection from oxidation and impacts during attachment to the PC board. This protective layer also serves as a means of providing for a surface for pick and place operations which use a vacuum pick-up tool.

This protective layer 56 helps to control the melting, ionization and arcing which occur in the fusible link 42 during current overload conditions. The protective layer 56 or cover coat material provides desired arc-quenching characteristics, especially important upon interruption of the fusible link 42.

The protective layer 56 may be comprised of a polymer, preferably a polycarbonate adhesive. A preferred polycarbonate adhesive is LOCTITE 3981. Other similar adhesives are suitable for the invention. In addition to polymers, the protective layer 56 may also be comprised of plastics, conformal coatings and epoxies.

This protective layer 56 is applied to the strips 26 using a die. Particularly, the die has openings which correspond to the width of the strips 26. The polycarbonate adhesive is applied within the confines of the die openings, thereby covering only the strips 26. The strips 26 and the die are then placed in a UV light chamber and left for approximately 7 minutes. At the end of the 7 minutes, the polycarbonate adhesive has solidified, forming the protective layer 56.

Although a colorless, clear polycarbonate adhesive is aesthetically pleasing, alternative types of adhesives may be used. For example, colored, clear adhesives may be used. These colored adhesives may be simply manufactured by the addition of a dye to a clear polycarbonate adhesive. Color coding may be accomplished through the use of these colored adhesives. In other words, different colors of adhesives can correspond to different amperages, providing the user with a ready means of determining the amperage of any given fuse. The transparency of both of these coatings permit the user to visually inspect the fusible link 42 prior to installation, and during use, in the electronic device in which the fuse is used.

The use of this protective layer 56 has significant advantages over the prior art, including the prior art, so-called, "capping" method Due to the placement of the protective layer 56 over the entire top portion 38 of the fuse body, the location of the protective layer relative to the location of the fusible link 42 is not critical.

The strips 26 are then ready for a so-called dicing operation, which separates those strips 26 into individual fuses. In this dicing operation, a diamond saw or the like is used to cut the strips 26 along parallel planes 57 (FIG. 11) into individual thin film surface-mounted fuses 58 (FIG. 12). The cuts bisect the wide terminal areas 60 and 62 of the thin film copper patterns. These wide terminal areas 60 and 62 appear on either side of the fusible link 42.

This cutting operation completes the manufacture of the thin film surface-mounted fuse 58 (FIG. 12) of the present invention.

Fuses in accordance with this invention are rated at voltages and amperages greater than the ratings of prior art devices. Tests have indicated that fuses in accordance with this invention would have a fuse voltage rating of 60 volts AC, and a fuse amperage rating of between 1/16 ampere and 5 amperes. Even though the fuses in accordance with this invention can protect circuits over a broad range of amperage ratings, the actual physical size of these fuses remains constant.

In summary, the fuse of the present invention exhibits improved control of fusing characteristics by regulating voltage drops across the fusible link 42. Consistent clearing times are ensured by (1) the ability to control, through deposition and photolithography processes, the dimensions and shapes of the fusible link 42 and wide terminals 60 and 62; and (2) proper selection of the materials of the fusible link 42. Restriking tendencies are minimized by selection of an optimized material for the substrate 13 and protective layer 56.

While the specific embodiments have been illustrated and described, numerous modifications come to mind without significantly departing from the spirit of the invention, and the scope of protection is only limited by the scope of the accompanying Claims.

What we claim is:

1. A thin film surface-mount fuse, said fuse comprising two material subassemblies:

a. the first subassembly comprising a fusible link, a supporting substrate and terminal pads with a plurality of conductive terminal pad layers, the supporting substrate having an upper surface, lower surface and opposing side surfaces, a first of the plurality of conductive terminal pad layers and the fusible link formed as a single-continuous layer and extending across the upper surface of transporting substrate, the first of the conductive terminal pad layers further extending over at least a part of the opposing side surfaces and terminating on the lower surface of the substrate; and, b. the second subassembly comprising a single protective layer which overlies the fusible link so as to provide protection from impacts and oxidation.

2. The surface-mount fuse of claim 1, wherein said protective layer is made of a polymeric material.

3. The surface-mount fuse of claim 1, wherein said protective layer is made of a polycarbonate adhesive.

4. The surface-mount fuse of claim 1, wherein said supporting substrate is made of an FR-4 epoxy or a polyimide.

5. The surface-mount fuse of claim 2, wherein said polymeric material is clear and colorless.

6. The surface-mount fuse of claim 2, wherein said polymeric material is clear and colored.

7. A thin film surface mount fuse comprising:

a. a substrate;

b. a fusible link and a first terminal pad layer formed as a single continuous layer disposed on the substrate, wherein the fusible link and the first terminal pad layer are made of a metal selected from a group consisting of copper, silver, nickel, titanium, aluminum and alloys thereof;

c. a second terminal pad layer disposed on the first terminal pad layer, wherein the second terminal pad is made of the same metal as the first layer;

d. a third terminal pad layer disposed on the second terminal pad layer, wherein the third terminal pad layer is made of nickel; and, e. a fourth terminal pad layer disposed on the third terminal pad layer, wherein the fourth terminal pad layer is made of tin.

8. The surface mount fuse of claim 7, wherein the fusible link has a central portion, a tin spot being disposed on the central portion.

9. The surface mount fuse of claim 8, wherein a protective coating is applied over the fusible link.

10. The surface mount fuse of claim 9, wherein the protective coating is also applied over a portion of the fourth terminal pad layer.

11. A thin film surface-mount fuse, said fuse comprising:

a. a substrate;

b. a fusible link made of a first conductive metal deposited on the substrate;

c. a second conductive metal, other than the first conductive metal, deposited on the surface of the fusible link; and, d. terminal pads electrically connected to the fusible link, the terminal Dads having a plurality of conductive layers, wherein a first of the plurality of conductive layers and the fusible link form a single continuous film and wherein a second of the plurality of conductive layers is deposited on the first of the plurality of conductive layers and consists of the same metal as the first conductive metal.

12. The device of claim 11, wherein a third of the plurality of conductive layers is deposited on the second of the plurality of conductive layers and consists of nickel.

13. The device of claim 12, wherein a fourth of the plurality of conductive layers is deposited on the third of the plurality of conductive layers and consists of tin.

14. The surface-mount fuse of claim 13, wherein the first conductive metal is selected from the group including copper, silver, nickel, titanium, aluminum or alloys thereof.

15. The surface-mount fuse of claim 14, wherein the second conductive metal is tin.

16. The surface-mount fuse of claim 15, wherein the second conductive metal is deposited onto the fusible link in the form of a rectangle.

17. The surface-mount fuse of claim 16, wherein the fusible link has a central portion and the rectangle is deposited along the central portion of said fusible link.

* * * * *

UNITED STATES PATENT AND TRADEMARK OFFICE

CERTIFICATE OF CORRECTION

PATENT NO. : 5,552,757

DATED : Sep. 3, 1996

INVENTOR(S) : Blecha et al.

It is certified that error appears in the above-indentified patent and that said Letters Patent is hereby corrected as shown below:

In Claim 1, Col. 8, line 64, delete "transporting" and insert therefor --supporting--.

In Claim 11, Col. 10, line 12, delete "Dads" and insert therefor --pads--.

Signed and Sealed this

Twentieth Day of May, 1997

*Attest:*

*Attesting Officer*

Bruce Lehman

BRUCE LEHMAN

*Commissioner of Patents and Trademarks*